US007811522B2

(12) United States Patent
Mathus et al.

(10) Patent No.: US 7,811,522 B2
(45) Date of Patent: Oct. 12, 2010

(54) SAMPLE RESERVOIR KITS WITH DISPOSABLE LINERS

(75) Inventors: Greg Mathus, Concord, MA (US); Terrence Kelly, Lowell, MA (US)

(73) Assignee: Viaflo Corporation, Hudson, NH (US)

( * ) Notice: Subject to any disclaimer, the term of this patent is extended or adjusted under 35 U.S.C. 154(b) by 518 days.

(21) Appl. No.: 11/773,819

(22) Filed: Jul. 5, 2007

(65) Prior Publication Data

US 2009/0008405 A1 Jan. 8, 2009

(51) Int. Cl.
*B65D 21/00* (2006.01)
*B65H 1/00* (2006.01)

(52) U.S. Cl. ..... 422/102; 422/99; 422/100; 422/104; 206/386; 206/499; 220/23.9; 220/495.01; 220/495.06; 220/574.3

(58) Field of Classification Search ..... 422/99, 422/100, 102, 104; 206/386, 499; 220/23.9, 220/495.01, 495.06, 574.3
See application file for complete search history.

(56) References Cited

U.S. PATENT DOCUMENTS

| | | | | |
|---|---|---|---|---|
| 5,248,056 | A * | 9/1993 | Shaw | 422/102 |
| 6,180,065 | B1 | 1/2001 | Homola | |
| 6,769,302 | B1 * | 8/2004 | King et al. | 73/427 |
| 6,800,491 | B2 * | 10/2004 | Ringleben et al. | 422/102 |
| 2001/0007307 | A1 * | 7/2001 | Karpisek | 206/386 |
| 2007/0289892 | A1 * | 12/2007 | Hogerty | 206/515 |

FOREIGN PATENT DOCUMENTS

| | | | |
|---|---|---|---|
| FR | 2551728 | A3 | 3/1985 |
| WO | 02/02237 | A1 | 1/2002 |

OTHER PUBLICATIONS

PCT Search Report dated Dec. 29, 2008.
PCT Search Report dated Mar. 18, 2009.
Deerac Fluidics—Product Note 140—Regent Reservoir Options for the Equator Series.
Deerac Fluidics—Equator Add-Ons—obtained from website: http://www.deerace.com/Products/equator_add_ons.439.html. Date Accessed: May 17, 2007.
Nunc Brand—Disposable Reservoirs—obtained from website: http://www.nuncbrand.com/print.aspx?id=1304. Date Accessed: May 17, 2007.

* cited by examiner

*Primary Examiner*—Jill Warden
*Assistant Examiner*—Sharon Pregler
(74) *Attorney, Agent, or Firm*—Andrus, Sceales, Starke & Sawall, LLP

(57) ABSTRACT

A liquid sample or liquid reagent reservoir kit employs a reusable reservoir base and disposable liners made of a clear transparent plastic material. Graduation marks are located on the sidewall surface of the basin in the reusable reservoir base, and are calibrated to measure liquid volumes in a disposable liner placed within the reusable reservoir base. The transparency of the clear disposable liner allows the liquid volume graduation marks on the sidewall of the basin in the reusable base to be observed through the disposable liner. The disposable liners are configured so that the liners can also be used as a cover. The geometry of the disposable liners facilitates tight nesting of stacked liners to facilitate shipping as well as storage on the laboratory bench top.

13 Claims, 15 Drawing Sheets

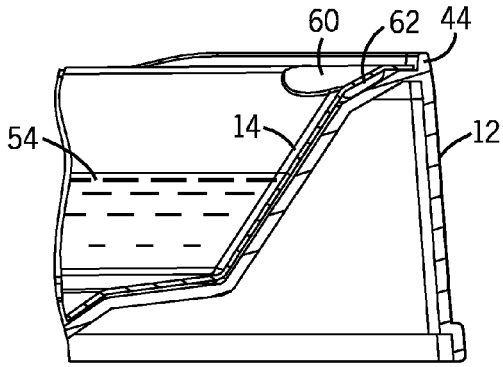
FIG. 11
FIG. 12
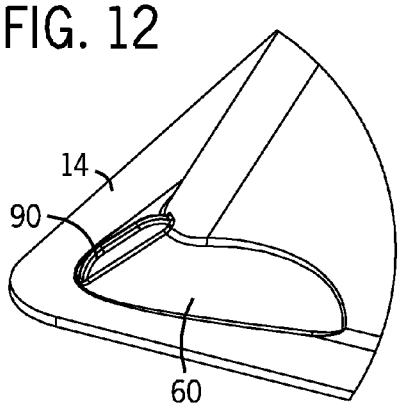
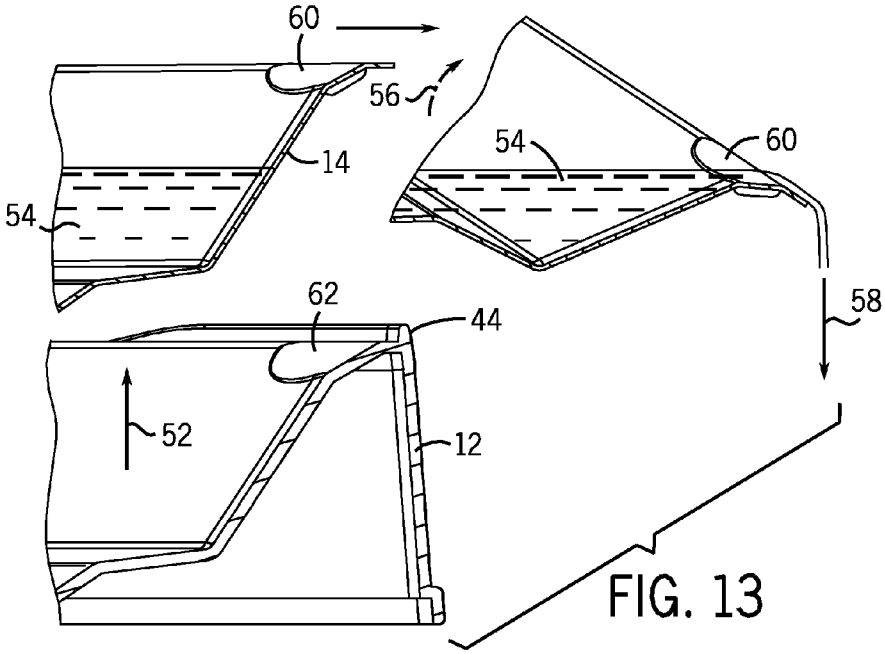
FIG. 13

FIG. 29
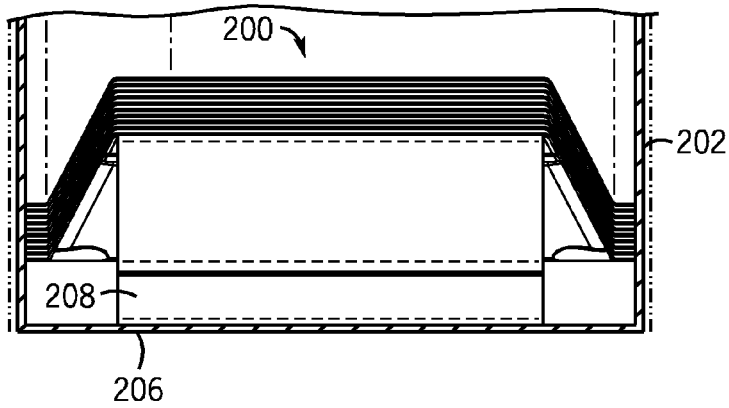
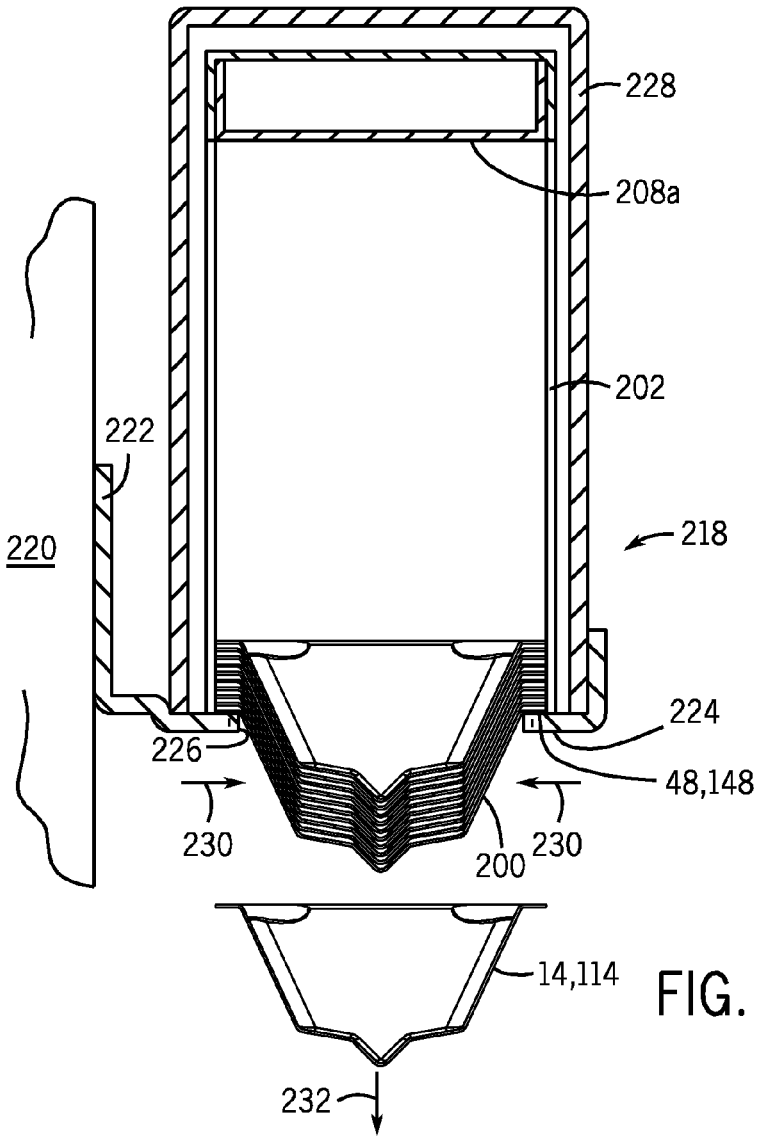
FIG. 30

SAMPLE RESERVOIR KITS WITH DISPOSABLE LINERS

FIELD OF THE INVENTION

The invention relates to clinical and research laboratory products, and in particular, liquid sample or liquid reagent reservoirs.

BACKGROUND OF THE INVENTION

Liquid sample or liquid reagent reservoirs are commonly used in clinical and research laboratory applications. The reservoirs sit the flat deck surface of a laboratory workbench, and typically contain a basin for directly receiving and holding a liquid sample or reagent for use by the laboratory worker. Some reservoir kits use disposable inserts or liners. The dimensions of the basin are quite often chosen in order to accommodate use of the reservoir with, not only single channel pipettes, but also multi-channel pipettes. Thus, it is not unusual for the reservoir and its basin to be elongated, as desired, to accommodate use with 8-channel or a 12-channel pipette. Also, it is typical that reservoir basins include a narrow longitudinal trough along the bottom surface at its centerline to minimize the dead volume. Sometimes, the troughs are sloped to a single low point in order to further minimize dead volume, although this is not preferred when the system is designed for multi-channel use. Quite often, the sidewall of the reservoir includes liquid volume graduation marks, either molded into the sidewall or printed thereon.

The use of disposable reservoir liners can avoid the need to clean and/or sterilize reservoirs before starting a new procedure. Known liners are made of opaque vacuum formed plastic, and generally comprise a basin that follows the contour of the reusable reservoir base. The liner typically includes a peripheral flange that extends outward around the upper end of the basin. With this geometry, such disposable liners must be used in connection with a supporting base because the liners are unable to stand vertically on a flat surface without the support of the base. Nevertheless, many laboratory workers find that using reservoir kits with disposable liners can be quite helpful for many procedures.

SUMMARY OF THE INVENTION

The invention is directed to an improved liquid sample or liquid reagent reservoir kit employing disposable liners, and methods for using and packaging the kits.

In one aspect, the invention is directed to a laboratory liquid sample or reagent kit having at least one reusable reservoir base with an elongated basin and a disposable liner made of a transparent plastic material. The transparent disposable liner has a basin with a shape that closely follows the contour of the basin in the reusable reservoir base. The reusable reservoir base, and in particular its basin, is preferably made of an opaque material. Distinct liquid volume graduation marks are located on a sidewall surface of the basin in the reusable reservoir base. These marks are calibrated to measure liquid volumes in a disposable liner placed in the reservoir base. The transparency of the disposable liner allows the liquid volume graduation marks on the sidewall of the basin in the reusable base to be observed through the disposable liner when the liner is set in place within the base.

Preferably, the disposable liner has a peripheral flange that extends outwardly from the top of the liner basin, which is designed to rest on a rim above the basin in the reusable base when the disposable liner is set in place within the base. In this manner, the disposable liner hangs within the reusable base with slight clearance between the liner basin and the basin of the base. If the disposable liner is hung in the proper relation to the reservoir base, it has been discovered that reflection of light by liquid (e.g., water) in the disposable liner blocks the view of liquid volume graduation marks on the basin sidewall of the reservoir base below the top surface of the liquid. The view of the user is blocked in this manner for a wide array of user viewing angles. For this reason, it is preferred that liquid volume indicators on the basin sidewall of the reusable base, such as 20 ml, 40 ml, 60 ml, 80 ml, 100 ml be located slightly above the graduation mark to which it is associated.

The reservoir liners are preferably made of clear polished plastic material, such as clear injection molded polystyrene. It is also preferred that the basin in the reusable base have a surface with a satin finish, so that laboratory workers can easily notice whether the clear disposable liner with a polished surface is located within the reusable reservoir base or not.

In order to facilitate pouring of liquid sample or reagent from the disposable liner, the preferred disposable liner has a pouring spout formed at the intersection of the upper ends of the endwalls and sidewalls. Further, the upper rim of the reservoir base surrounding its basin contains a pair of opposed finger access openings along opposed longitudinal edges. This allows the user to conveniently grasp the opposed longitudinal edges of the disposable liner and lift the liner from the base in order to pour liquid reagent or sample. Of course, liquid reagent or sample can also be dispensed effectively in normal operation using a pipette.

In the preferred embodiments of the invention, the upper rim of the reservoir base includes means for securing the disposable liner in place on the upper rim, such as a raised lip extending substantially around the periphery of the rim. In normal use, the peripheral flange that extends outwardly from the top of the liner basin rests on the upper rim of the base with the raised lip substantially surrounding the peripheral flange when the disposable liner is set in place within the reusable base. This feature is particularly useful when, as now described, a second disposable liner is inverted and used as a cover.

Another aspect of the invention is directed to a method of using the sample reservoir kit in which two disposable liners are used in connection with the reusable reservoir base, one of the disposable liners being used for a cover. As described above, a first disposable liner is placed in the reusable base ready to receive liquid, such that the peripheral flange of the first disposable liner rests on the upper rim of the reusable base. The securing means on the reusable base engages the peripheral flange of the first disposable liner, for example, the first disposable liner rests on the rim of the reusable base with the raised lip on the reusable base extending substantially around its peripheral flange. With the first disposable liner in place, it is filled with liquid sample or reagent and used in a normal course by the laboratory worker. When the worker desires, the worker places a second disposable liner as cover over the first disposable liner containing the liquid sample or reagent. To do so, the second disposable liner is inverted and placed on the peripheral flange of the first liner so that the peripheral flange of the second disposable liner rests on the peripheral flange of the first disposable liner. The peripheral flange of the second disposable liner is also engaged by the securing means on the reusable base. For example, in the preferred embodiment, the raised lip on the reusable base also extends substantially around the peripheral flange of the second disposable liner, thereby securing the second disposable liner (i.e., the cover) in place on the upper rim of the base.

When the laboratory worker desires to access the liquid sample or reagent, he or she merely removes the second disposable liner serving as a cover. This method, while useful in many circumstances, can be particularly useful in sterile applications. In order to further facilitate use in sterile applications, it may be desirable to provide, before the start of the procedure, sterilized disposable liners each having a peelable film sealed to the top surface of the peripheral flange before use.

In another aspect of the invention, the geometry of the disposable liners is designed to facilitate tight nesting of stacked liners. In sterile applications where a sterile disposable liner with a peelable film is required, nesting is not possible. In other applications, however, tight nesting of the disposable liners facilitates efficient shipping, storage and use. For example, space on the laboratory workbench is often at a premium, yet it is desirable that the liners be easily accessible to the laboratory workers when they are conducting procedures at the bench. Thus, it is quite desirable that the design of the disposable liner fosters tight nesting yet ensures that individual liners can be easily removed from the stack without difficulty. In order to foster tight nesting as well as releasability of individual liners from the nested stack, it has been determined that the endwalls and longitudinal sidewalls of the disposable liners should have a draft angle of at least approximately 40°. Even so, in accordance with this aspect of the invention, further means are provided to facilitate the release of individual liners from the nested stack. Such means may contain mechanical means such as raised beads formed on the undersurface of the peripheral flange at each corner of the liner. On the other hand, such means may consist of a release agent added to the plastic material forming the disposable liners, or coated to the surface of the disposable liners. Preferably, the configuration of the disposable liners is such that the fully nested stacking density is no less than 60% volume of plastic per total stack volume.

Another aspect of the invention addresses the packaging of nested stacks of disposable liners. In this aspect of the invention, it is preferred that a sleeve made of cardboard holds an inverted stack of nested liners. The sleeve preferably comprises a pair of endwalls and a pair of sidewalls extending upward from a bottom wall. An inserted standoff (or false bottom) provides support for the inverted stack of reservoir liners. The sidewalls each contain an open area that extends from the top of the sleeve to a level located above the bottom wall thereby providing access to manually remove one or more liners stacked on the inserted standoff from the sleeve. The inserted standoff is preferably a cardboard or foam tent-like structure that is placed in the sleeve to lift the stack of liners off the base or bottom wall of the sleeve. The inserted standoff protects the liners at the bottom of the stack from being damaged in shipment by transferring the load to the apex of the reservoir basin. The inserted standoff serves the additional function of bringing the bottom of the stack of liners even with the open area of the sleeve, thus providing convenient access to the last of the liners in the stack. Preferably, a cover that slides over the sleeve is also provided. Such an arrangement is quite compact and convenient to use on the laboratory workbench. Also for shipping purposes, a master pack box can contain several sleeves, and also contain at least one reusable reservoir base.

Another aspect of the invention pertains to a dispenser for the disposable liners, which is preferably mounted to a fixed surface, such as a wall, in the vicinity of the laboratory bench. The preferred dispenser includes a support frame with a platform having an elongated opening. The platform holds a stack of nested liners, preferably still in the cardboard sleeve described above, with the sleeve opening facing downward like the platform opening. The peripheral flange of the lowermost liner rests on the support platform such that the basin on the lowermost liner extends downward through the sleeve and platform openings and is exposed below the dispenser. When a laboratory worker desires to dispense a disposable liner, the worker manually grasps opposed longitudinal sidewalls of the lowermost liner. As the sidewalls are depressed inward, the stack of liners above the lowermost liner is raised within the dispenser and the lowermost liner being flexible narrows. The lowermost liner is then easily dispensed downward from the dispenser. Preferably, a dust cover is provided to fit over the sleeve of the disposable liners in the dispenser. Alternatively, an escapement mechanism can be provided to release one liner at a time.

BRIEF DESCRIPTION OF THE DRAWINGS

FIG. 11 is a cross-sectional view similar to FIG. 8, but taken through a corner of the kit.

FIG. 12 is a detailed view of the corner portion of a disposable liner in accordance with an embodiment of the invention as viewed from the underside of the corner.

FIG. 13 is a schematic drawing illustrating the removal of a disposable liner from the reusable base in order to pour liquid sample or reagent from the disposable liner.

FIGS. 27 through 29 illustrate a preferred packaging and dispensing sleeve for an inverted stack of nested disposable liners.

FIG. 30 shows a dispenser for the disposable liners.

DETAILED DESCRIPTION OF THE INVENTION

Figure 1:
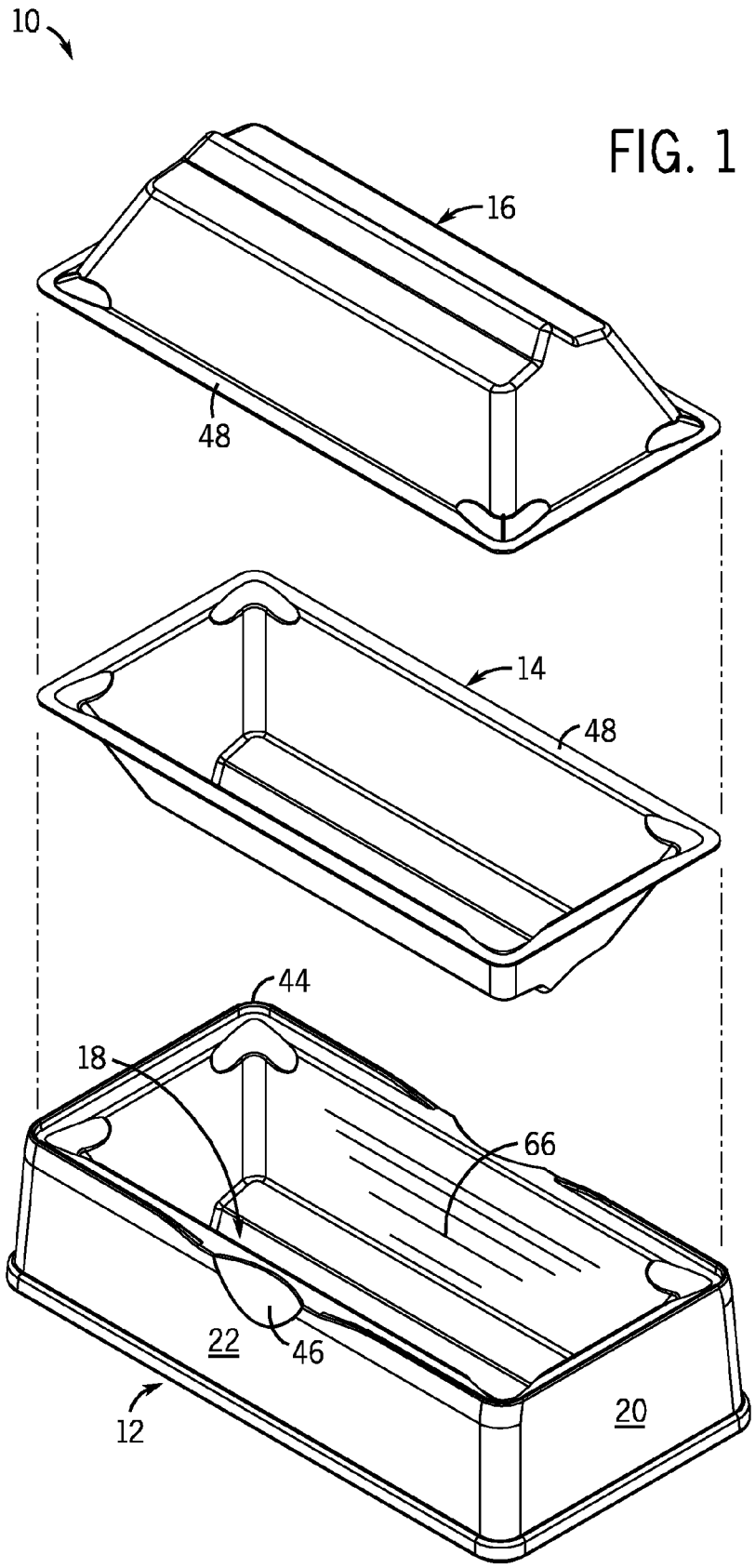
FIG. 1 is an exploded perspective view of a liquid sample or liquid reagent reservoir kit in accordance with a preferred embodiment of the invention.

FIGS. 1-15 illustrate a liquid sample or liquid reagent reservoir kit 1 construction in accordance with a first preferred embodiment of the invention. The kit includes a reservoir base 12 and a first disposable liner 14 and a second disposable liner 16. The liners 14 and 16 are identical. The kit 10 is designed to hold liquid sample or liquid reagent in disposable liner 14 when disposable liner 14 is placed within the reusable reservoir base 12, as shown for example, in FIGS. 2 and 8. The kit 10 is designed to hold up to 100 ml of liquid sample or reagent, although the capacity of the liner 14 is sufficient to handle substantial overfilling. The liner 16, as depicted, can be used as an optional cover if desired.

The reservoir base 12 contains a basin 18 into which the disposable liner 14 is placed. The contour of the disposable liner 14 closely follows the shape and contour of the basin 18 of the reusable base 12. Outer sidewalls 22 and endwalls 20 on the reusable base 12 provide support for the reservoir base 12 and its basin 18 on flat surfaces such as the laboratory bench top. While the reservoir base 12 can be made from a variety of materials, it is preferred that the base 12 be made of relatively rigid injection molded plastic having an opaque color, such as white polypropylene, polycarbonate or polystyrene. It is preferred that the surface of the basin 18 have a satin finish. On the other hand, as mentioned above, it is preferred that the disposable liners 14 and 16 be made of clear transparent plastic having a polished surface, such as clear injection molded polystyrene, polypropylene or polyester having a thickness of approximately 0.03 mils. The polished or shiny surface of the clear liner, in contrast to the satin finish on the opaque colored basin 18 in the base 12, renders it more conspicuous to laboratory workers whether or not the transparent liner 14 is present within the reservoir base 12. Injection molding is the preferred method for the liners 14 and 16 because it is desirable for the liner thickness to be constant throughout. It should be recognized, however, that other manufacturing means and thickness specifications may be possible for both the disposable liners and the reusable base 12.

Figure 9:
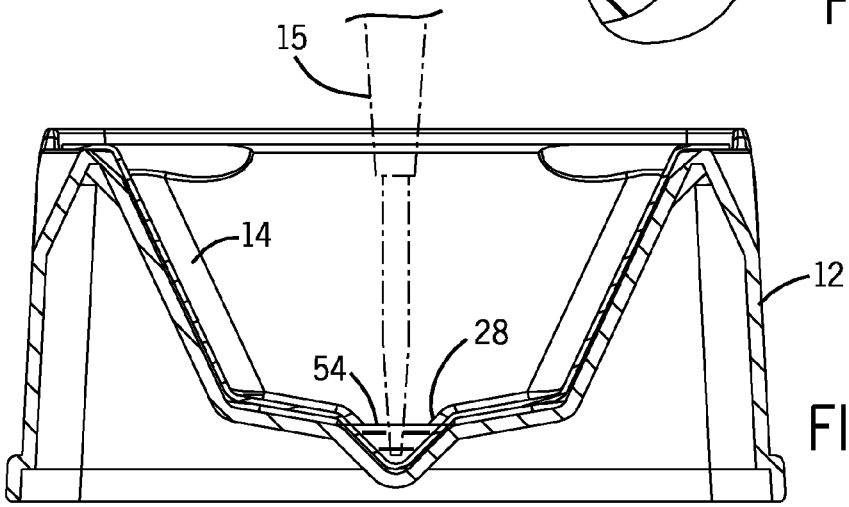
FIG. 9 is a view similar to FIG. 8 illustrating an aspirating pipette being used to aspirate liquid from a narrow longitudinal trough extending along the bottom of the basin of the disposable liner.

Referring now in particular to FIGS. 2-5, the basin 18 in the reusable base 12 includes a narrow longitudinal trough 24 extending along its bottom surface 26. Since the contour of the disposable liner 14 closely follows the contour of the basin 18 in the reusable base 12, the disposable liner 14 also includes a narrow longitudinal trough 28 which extends between the endwalls of the disposable liner 14. Referring briefly to FIG. 9, the trough 28 in the disposable liner reduces the amount of dead volume in the reservoir liner 14. FIG. 9 shows the pipette tip 15 (shown in phantom) accessing liquid 54 contained in the trough. Referring again to FIGS. 2-5, the basin 18 in the reusable base 12 includes a pair of endwalls 30 and a pair of longitudinal sidewalls 32. The basin 18 also includes a pair of longitudinal steps 34 each extending longitudinally along the respective side of the trough 24 and connecting the trough 24 to the respective sidewall 32. The use of the steps 34 allows the basin 18 to widen substantially over a very short depth in order to accommodate greater volumes, yet also allows for the presence of the narrow longitudinal trough 24 to reduce dead volume when the last vestiges of liquid are being aspirated. The disposable liner 14 has a matching configuration, namely endwalls 36 and longitudinal sidewalls 38 as well as longitudinal steps 40 spanning between the longitudinal sidewalls 38 and the trough 28. The longitudinal steps 40 have a slight downward slope towards the centerline, e.g., approximately 10°. The draft angles for the endwalls 36 and the longitudinal sidewalls 38 are substantially similar, preferably approximately 25°, but no less than 20°, in order to foster effective nesting of the disposable liners. The relatively large draft angle allows the disposable liners 14 to stack tightly.

Figure 6:
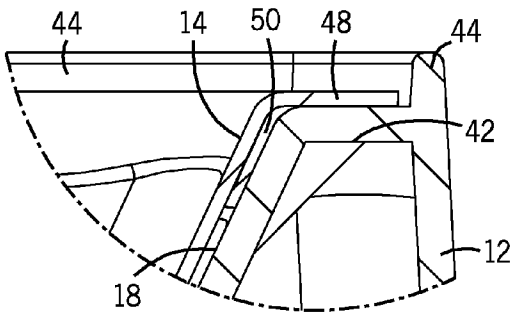
FIG. 6 is a detailed view of the area in FIG. 5 depicted by line 6-6, which illustrates in detail the relation between the peripheral flange of the disposable liner and the upper rim of the reusable reservoir base.

Referring now also to FIG. 6 in addition to FIGS. 2-5, the reusable reservoir base 12 has an upper rim 42 that extends around the circumference of the top of the basin 18. In the preferred embodiment, a raised lip 44 extends upward from the rim 42. As shown best in FIGS. 2 and 5, the raised lip 44 extends substantially around the entire circumference of the upper rim 42 except for locations along opposed center portions of the longitudinal sidewalls 22 of the base 12. The base 12 includes molded indentations 46 at these locations, which as discussed below, allows the user to conveniently grasp the disposable liner 14 to lift the liner 14 from the base 12.

The disposable liner 14 includes a peripheral flange 48 that extends outwardly from the upper end of the basin defined by the sidewalls 38 and endwalls 36 of the disposable liner 14. As shown best in FIG. 6, the peripheral flange 48 of the disposable liner 14 rests on the upper rim 42 of the base 12 when the disposable liner 14 is placed within the base 12. The liner 14 hangs within the base 12 so that there is a slight clearance 50 (FIG. 6) between the basin 18 in the base 12 and the disposable liner 14.

The raised lip 44 helps to secure the disposable liner 14 within the base 12, especially in the event that a laboratory worker attempts to pour liquid sample or reagent from the disposable liner 14 while the liner 14 remains in place within the base 12. Referring now to FIG. 13, it is advised in the preferred embodiment that the user lift the liner 14 from the reusable base 12 as depicted by arrow 52 before pouring liquid 54 contained in the liner 14 from the liner, as depicted by arrows 56 and 58 in FIG. 13. In order to facilitate such pouring, it is preferred to provide a pouring spout 60 at each corner of the disposable liner 14. The base 12 includes depressions 62 in order to accommodate the corner pouring spouts 60 in the disposable liner 14.

Figure 7:
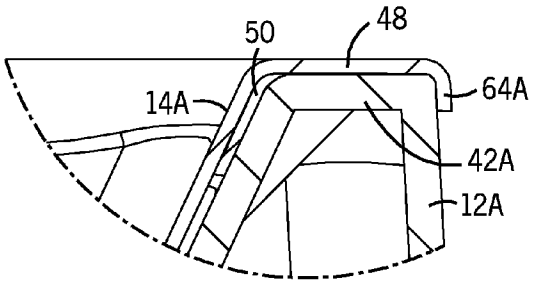
FIG. 7 is a detailed view similar to FIG. 6 but showing an alternative embodiment for the configuration of the upper rim of the reservoir base and the peripheral flange of the disposable liner.
Figure 8:
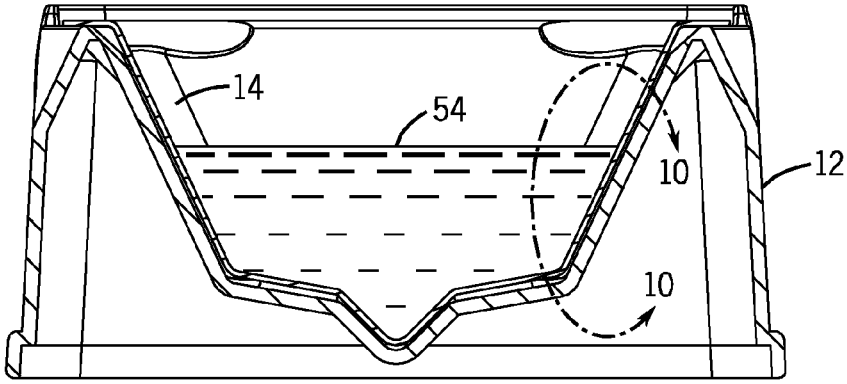
FIG. 8 is a schematic cross-sectional view similar to the view shown in FIG. 4 illustrating the reservoir kit having liquid sample or liquid reagent contained in the disposable liner.

As mentioned with respect to FIGS. 6 and 13, it is not advised for the user to try to pour liquid from the disposable liner 14 when it is in place in the base 12. One of the primary reasons is that there is some likelihood that the disposable liner 14 could slide from the base 12 when the liquid is poured while the disposable liner remains in the base. Thus, it is preferred to provide the raised lip 44 at the corner to discourage pouring with the liner 14 in the base 12. FIG. 7, however, shows an alternative embodiment of the upper rim 42*a* of the base 12*a* and the peripheral flange 48*a* of the disposable liner 14*a*, in which the raised lip 44 is removed. In the embodiment shown in FIG. 7, the peripheral flange 48*a* includes a downwardly extending hook 64*a* which serves to secure the liner 14*a* within the base 12*a*. Because the raised lip 44 has been removed from the upper rim 42*a*, pouring from the disposable liner 14*a* when the liner is in place in the base 12*a* is not discouraged as much by the construction of the device as in the embodiment shown in FIG. 6.

Referring generally to FIGS. 1-15, the preferred dimensions for the disposable liner 14 are selected in order to provide ample volume for 100 ml of liquid sample or reagent, as well as provide a longitudinal length sufficient to accommodate conventional 8-channel and 12-channel pipettes. Using these criteria, the preferred dimensions of the basin of the disposable liner 14 are 2.4 inches between the top of the sidewalls 38, 5.55 inches between the top of the endwalls 36, a depth of 1.45 inches, and due to the preferred draft angle of the sidewalls and endwalls, the approximate length of the trough if 4.25 inches. The width of the peripheral flange 48 is preferably approximately 0.25 inches.

Figure 2:
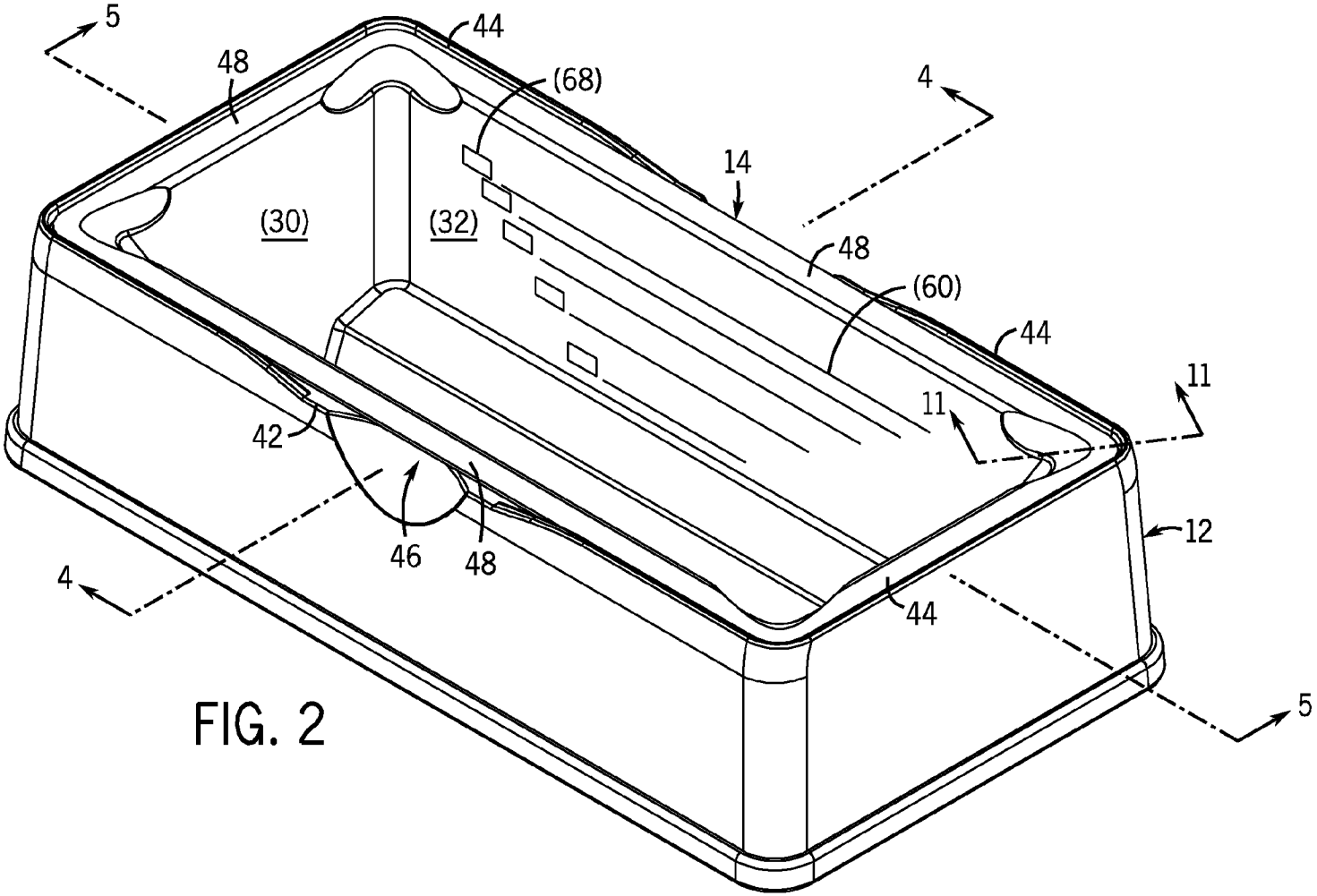
FIG. 2 is a perspective view of a reusable reservoir base with a disposable liner placed therein, both being configured in accordance with the embodiment of the invention shown in FIG. 1.
Figure 3:
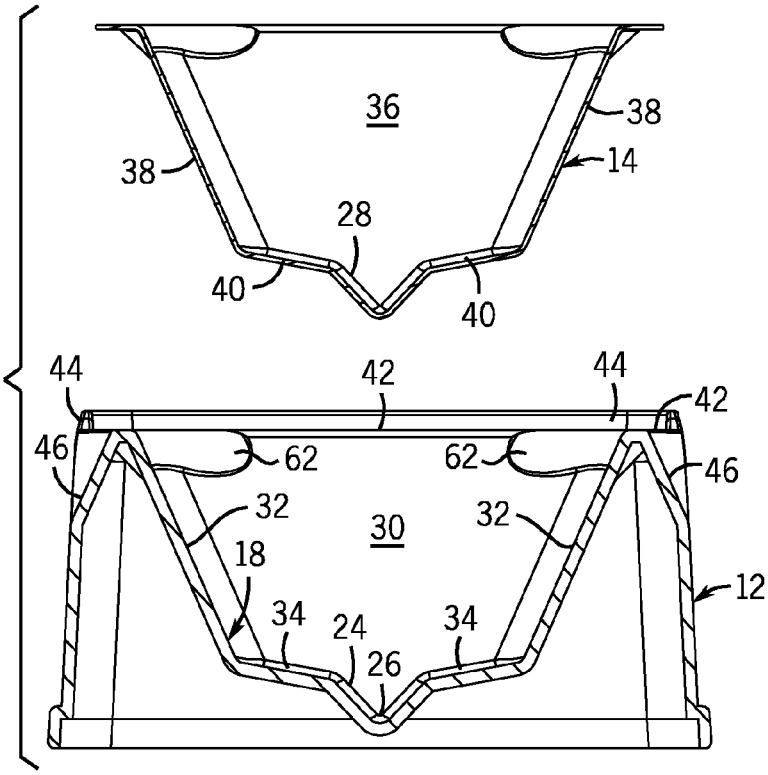
FIG. 3 is a cross-sectional view of the reusable reservoir base shown in FIG. 2 with the disposable liner shown in FIG. 2 lifted from the base. The section is taken along the same plane as in FIG. 4.
Figure 4:
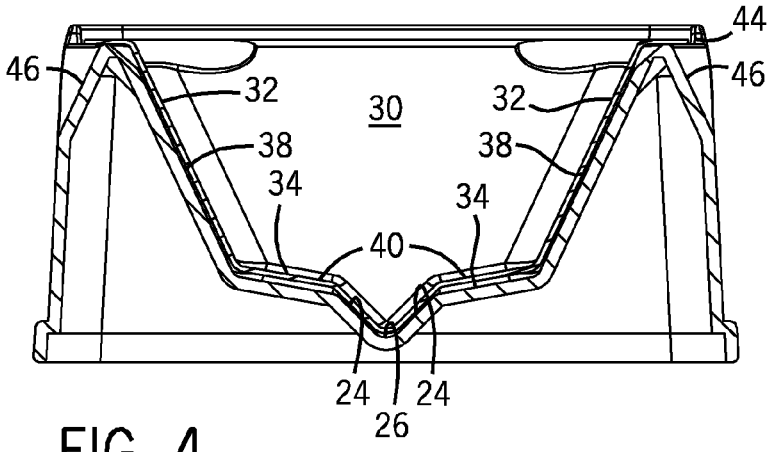
FIG. 4 is a cross-sectional view of the reusable reservoir base with the associated liner placed therein, as taken along line 4-4 in FIG. 2.
Figure 5:
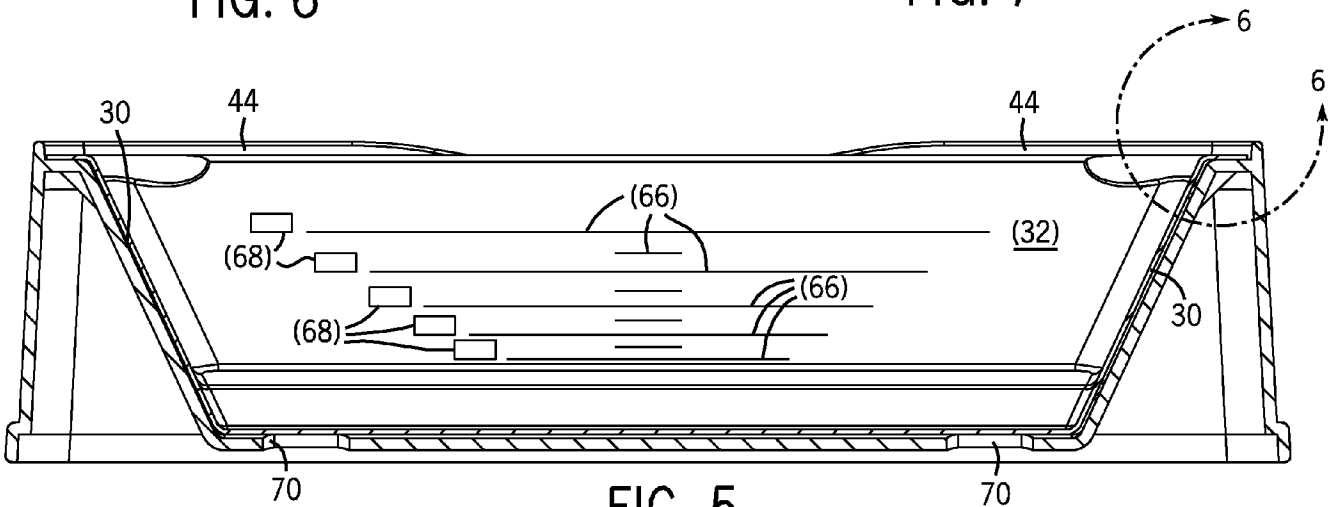
FIG. 5 is a longitudinal cross-sectional view of the reusable reservoir base shown in FIG. 2 with the disposable liner placed therein as taken along line 5-5 in FIG. 2.
Figure 10:
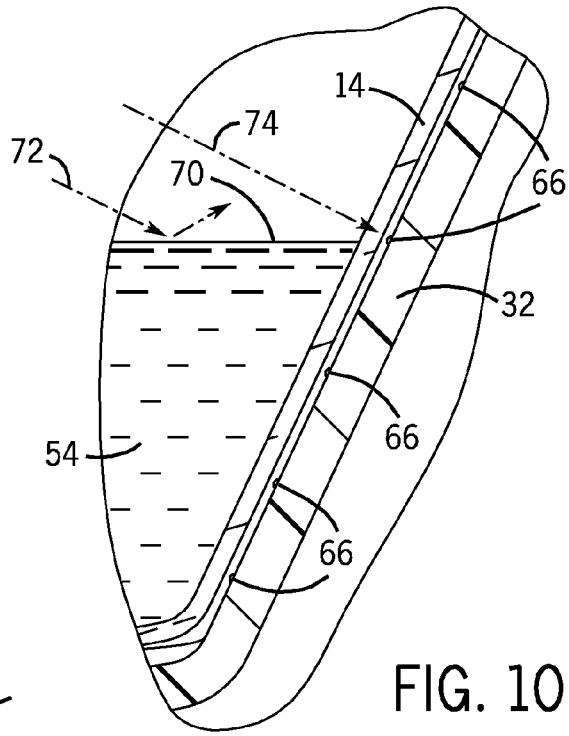
FIG. 10 is a detailed view of the area defined by lines 10-10 in FIG. 8 which illustrates the reflection of light by liquid contained within the disposable liner such that the view of volume graduation marks below the top surface of the liquid are blocked from view of a worker using the reservoir kit.

In accordance with the invention, at last one sidewall 32 of the basin 18 in the reusable base 12 contains liquid volume graduation marks 66, see FIG. 10. The liquid volume graduation marks 66 are preferably printed onto the sidewall 32, using pad printing or any other suitable process. The liquid volume graduation marks 66 on the sidewall 32 can be seen by the user through the clear, transparent liner 14 when the liner 14 is placed in the base 12. FIGS. 2 and 5 show the liner 14 placed in the base 12, and illustrate that the liquid volume graduation marks (66) on the basin sidewall of the base 12 can be viewed through the transparent plastic liner 14. In FIGS. 2 and 5, the reference number (66) for the liquid graduation marks has been placed in parenthesis in the figures to indicate that the marks are actually on the opaque surface of the base 12 underlying the clear transparent liner 14. Likewise, reference numbers (32) and (30) indicating the side and endwalls of the basin 18 in the base 12 underlying the transparent liner in these figures have been placed in parenthesis as well. Further, as shown in FIGS. 2 and 5, volume indicators (68) are printed on the basin sidewall (32) of the base 12. The reference number (68) are again placed in parenthesis in these figures to indicate that the volume amount indicators (68) are actually printed on the basin sidewall 32 of the base 12, but can be seen through the clear, transparent liner 14. While values for the volume indicators (68) are not illustrated per se in the drawings, a 100 ml kit 10 would typically include the values (68) of 20, 40, 60, 80 and 100 adjacent the associated volume liquid graduation mark. Since the kit 10 is intended to be used with the disposable liner 14 set in place within the base 12, the location of the graduation marks 66 is calibrated with respect to the volume of liquid contained within the disposable liner 14 when the disposable liner is in place, not with respect to the volume of the basin 18 of the base 12.

In fact, it is not desirable for the user to use the reusable reservoir base 12 as a stand-alone reservoir. The basin 18 in base 12 includes drainage openings 70, as shown in FIG. 5, in part to discourage the improper use of the reservoir base 12 as a stand alone reservoir without the use of a disposable liner 14. In addition, these holes prevent sticking of the disposable liners 14 to the reservoir base 12 should some liquid become located between the two surfaces.

Referring now in particular to FIG. 10, when liquid 54 is contained within the disposable liner 14, liquid volume graduation marks 66 below the surface 70 of the liquid 54 may be blocked from view to the user, depending on the user's angle of perspective. Arrows 72 and 74 in FIG. 10 illustrate this concept. Light traveling along the path indicated by arrow 72 is reflected from the top surface 70 of the liquid 54 (e.g., water) and thus prevents the user from seeing graduation marks 66 below the top surface 70 of the water 54. On the other hand, the user can view the graduation marks 66 above the surface 70 of the water as depicted by arrow 74. Thus, it is preferred that the volume indicators 68 on the basin sidewall 32 of the base 12 (see FIGS. 2 and 5) be printed at or above the calibrated liquid volume graduation marks 66 to which they are associated. This makes the liquid level easier to read.

Figure 14:
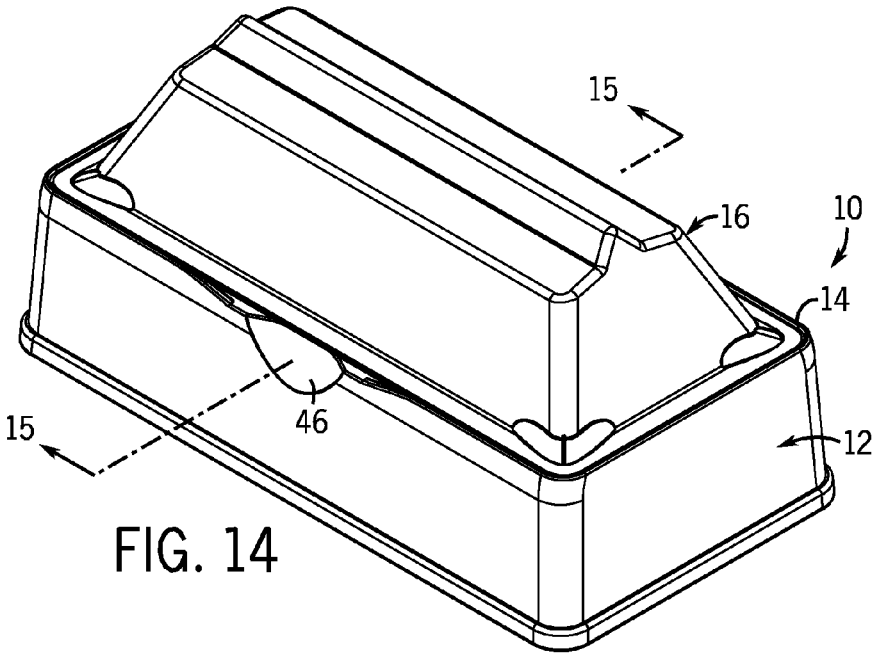
FIG. 14 is a perspective view illustrating another aspect of the invention in which a second disposable liner is used as a cover on the kit shown in FIGS. 1-13.
Figure 15:
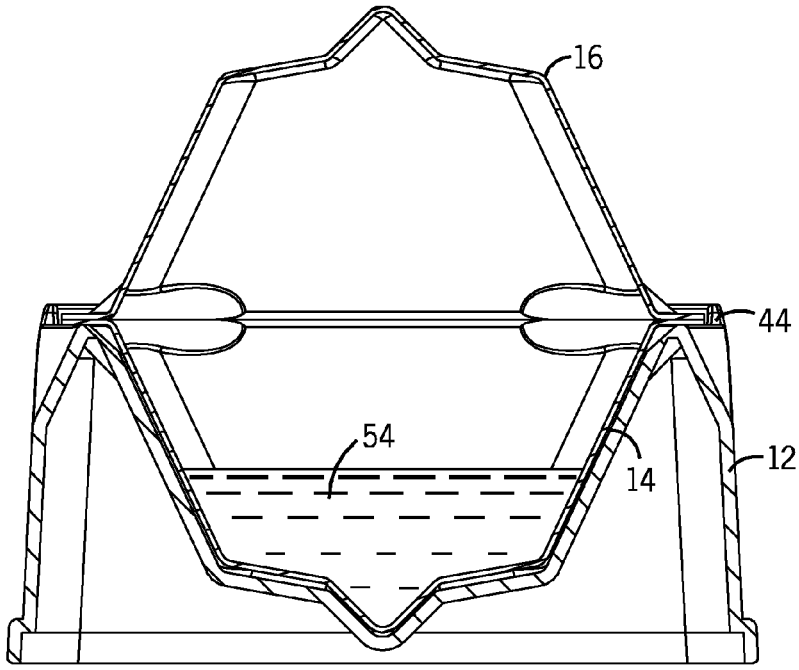
FIG. 15 is a cross-sectional view taken along line 15-15 in FIG. 14.
Figure 20:
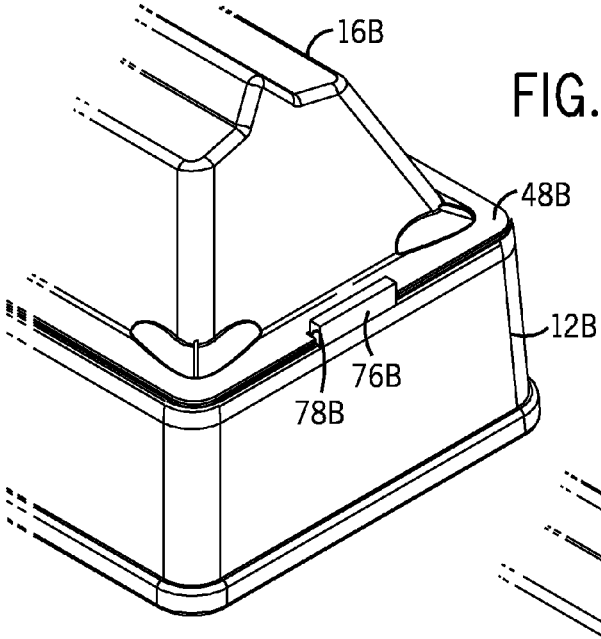
FIGS. 20-22 illustrate alternative means for securing a first disposable liner and a second disposable liner as a cover on the upper rim of the reusable base.
Figure 21:
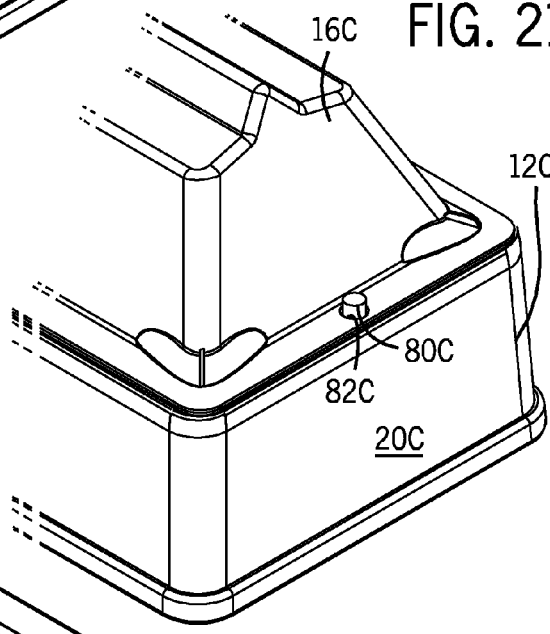
Figure 22:
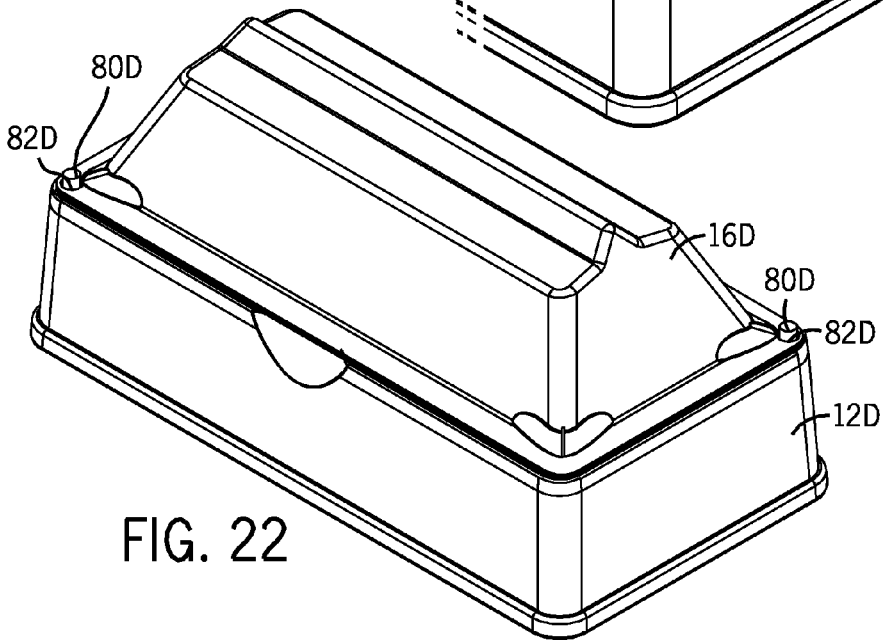

FIGS. 14 and 15 show the kit 10 with the second disposable liner 16 being used as a cover. The configuration of the disposable liner 16 is preferably identical to that of the disposable liner 14. The raised lip 44 on the base 12 serves to secure both the disposable liner 14 containing the liquid 12 and the disposable liner 16 being used as a cover. As mentioned previously, a laboratory worker merely removes the cover 16 in order to access the liquid 54 within the disposable liner 14 in the base. The finger indents 46 allow the user to easily grasp the peripheral flange along the longitudinal edges of the liner 16 (i.e., cover 16). FIGS. 20-22 show means alternative to the raised lip 44, for securing the liners 14 and 16 to the base 12. In FIGS. 20-22, it is difficult to see the disposable liner 14 containing the liquid except for the edge of its peripheral flange, but aside from the specific alterations addressed herein, it should be assumed that the overall configuration is generally the same as shown in FIGS. 14 and 15. In FIG. 20, the endwall of the base 12 includes an upwardly extending tooth 76. The peripheral flanges 48*b* on the disposable liners 16*b* and 14*b* (not shown) contain notches 78*b* corresponding to the location of the upwardly extending tooth 76 on the base 12*b*. In FIGS. 21 and 22, the upper rim of the base 12*c*, 12*d* includes one or more pegs 80*c*, 80*d*. In FIG. 21, the peg 80*c* is located at the top of the center portion of endwall 20*c*, and in FIG. 22 the pegs 80*d* are included at opposing corners. The peripheral flanges 48*c*, 48*d* in FIGS. 21 and 22 include holes 82*c* and 82*d* which correspond to the location of the pegs 80*c*, 80*d*, respectively. In all cases, it should be appreciated that the use of securing means as describe greatly enhance the stability of the cover 16 on the kit 10.

Figure 23:
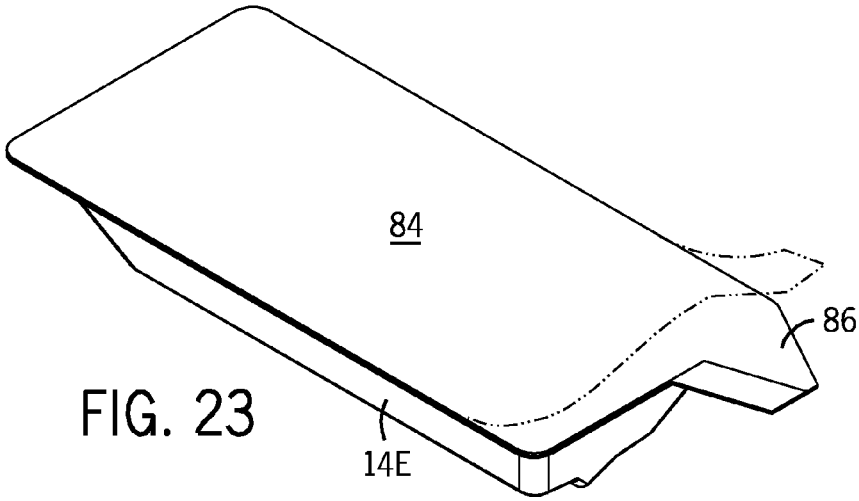
FIG. 23 illustrates an embodiment in which a sterile disposable liner is covered with a peelable seal.

FIG. 23 illustrates an embodiment, in which the disposable liner 14*e* has a sterile interior or basin, and a peelable seal 84 made of, for example, with sterile Tyvek, medical grade adhesive paper or foil, is secured to the peripheral flange of the sterile liner 14*e*. Alternatively, it may be desirable to use adhesive coated sterile paper, such as Latex impregnated paper which is heat sensitive, to apply the seal to the peripheral flange of the liner 14*e*. The peelable seal 84 includes a peel tab 86 to facilitate the peeling of the seal 84 to ready the sterile liner for use, as depicted by the phantom lines.

Figure 24:
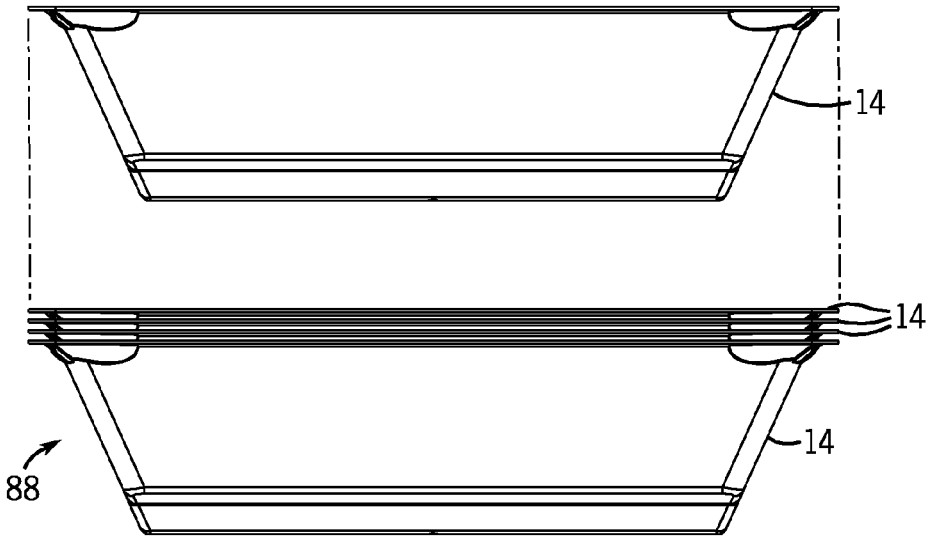
FIG. 24 illustrates a nested stack of disposable liners configured in accordance with a preferred embodiment of the invention.
Figure 25:
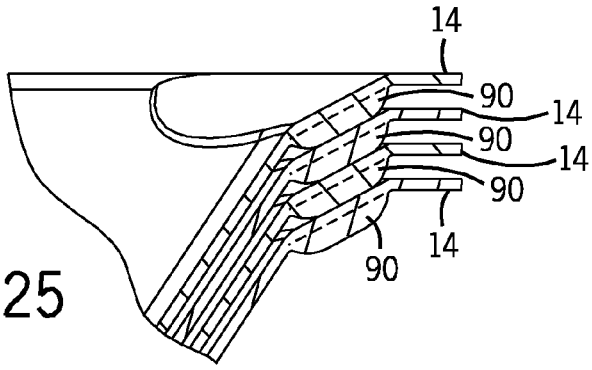
FIG. 25 is a detailed view illustrating beads extending downward from the surface of the disposable liner at the intersection of the peripheral flange and respective endwalls and sidewalls, to thereby facilitate release of individual disposable liners from a stack of nested liners, as shown in FIG. 24.

Referring now to FIGS. 11-12 and 20-25, in applications in which a sterile interior of the liner 14 is not required, it is desirable that the disposable liners 14 be capable of stacking in nested fashion (see, stack 88 in FIG. 24). As mentioned, the draft angles of the sidewalls and endwalls of the liner 14 are chosen, in part, to promote tight nesting, as well as facilitate the release of individual liners from a nested stack. It has been found, however, that it is desirable to provide further means to facilitate the releasability of individual liners 14 from the nested stack 88, FIG. 24. To this end, the disposable liner 14 preferably includes beads 90 that project downward from the underside of the disposable liner 14 at the corner of the peripheral flange 48 and the sidewalls and endwalls 36 and 38. The preferred geometry and location of the beads 90 is shown in FIG. 12. FIG. 25 shows the beads 90 providing standoff between adjacent liners 14 in a stack to prevent the adjacent liners 14 from sticking to one another. As an alternative to providing beads 90, it may be desirable to provide a chemical releasing agent (such as silicone or acrowax) on or within the plastic material used to mold the disposable liners 14, or coat the surface of the disposable liners 14 with such a releasing agent (for example silicone).

Figure 16:
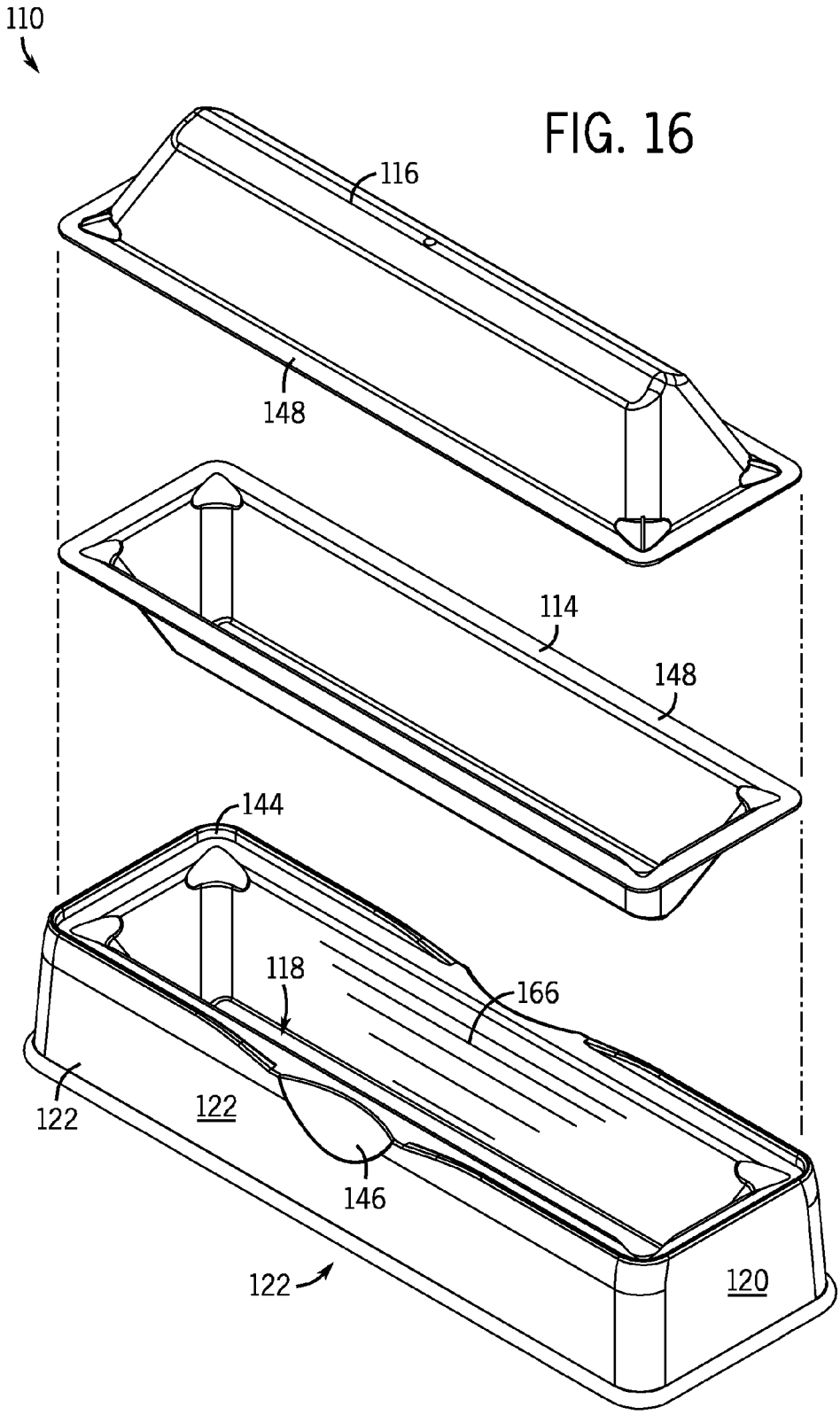
FIG. 16 is an exploded perspective view of a liquid sample or liquid reagent reservoir kit in accordance with a second preferred embodiment of the invention.
Figure 17:
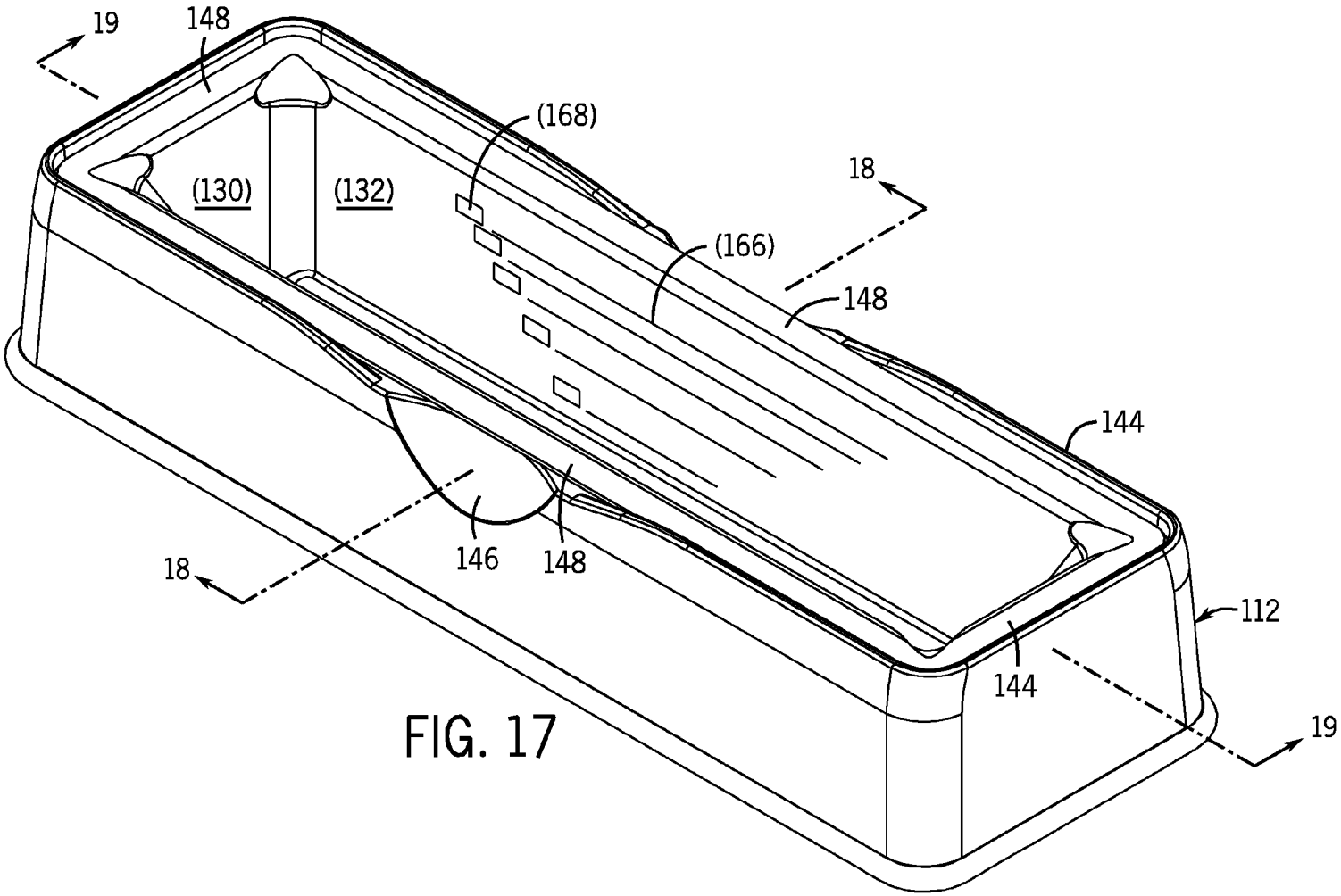
FIG. 17 is a perspective view of a reservoir base shown in FIG. 16 with an associated disposable liner placed therein.
Figure 18:
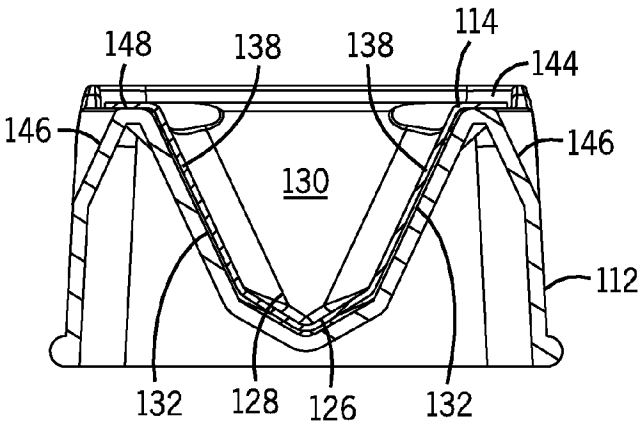
FIG. 18 is a cross-sectional view taken along line 18-18 in FIG. 17.
Figure 19:
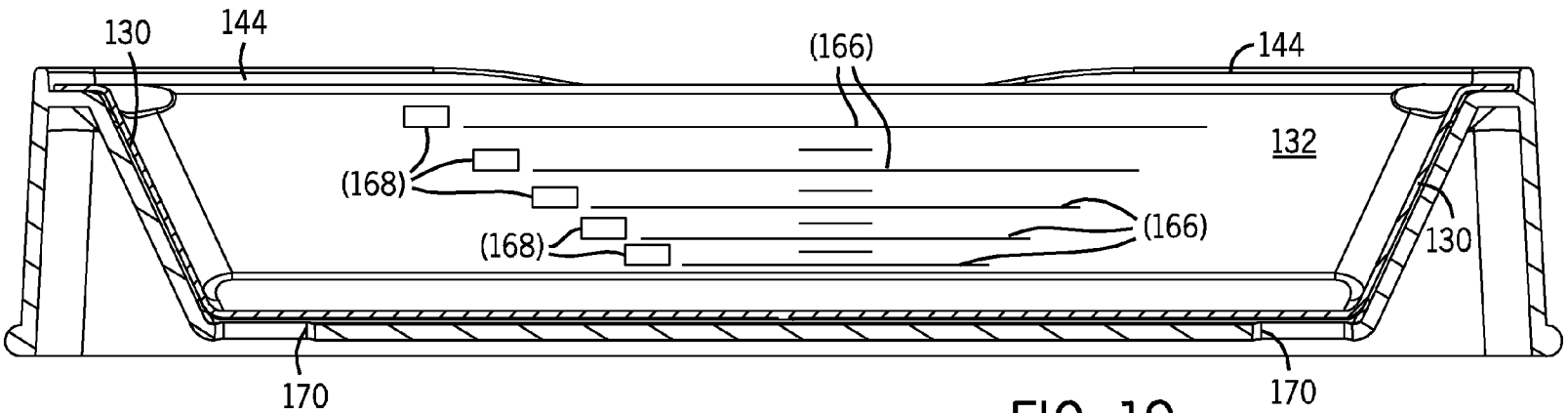
FIG. 19 is a longitudinal cross-sectional view taken along line 19-19 in FIG. 17.

FIGS. 16-18 illustrate a second preferred embodiment of the reservoir kit 110 constructed in accordance with the invention. The primary difference in the second embodiment 110 as compared to the first embodiment 10 described in FIGS. 1-15 is that the second embodiment 110 described in FIGS. 16-19 is designed to hold less volume, namely 25 ml instead of 100 ml. The primary difference in the construction, other than dimensional differences, is that the reservoir basin 118 for the 25 ml embodiment does not include longitudinal steps between the trough and the longitudinal sidewalls as is the case with the 100 ml embodiment. For the second embodiment shown in FIGS. 16-19, reference numbers in the figures correspond generally to the reference numbers used in connection with the embodiment in FIGS. 1-15 except the numbers have been increased in value by 100. For example, the reference number 12 is used to identify the reusable base in the 100 ml embodiment, and the reference number 112 is used to identify the reusable base in the 25 ml embodiment. Except for the noted difference with respect to the elimination of the longitudinal steps and the volume capacity, the features and functional design of the 25 ml embodiment of FIGS. 16-19 is similar to that of FIGS. 1-15. For example, in FIG. 17, the volume indicator values (168) printed on the basin sidewall 132 of the base 112 should be the values 5, 10, 15, 20, 25. The preferred dimensions for the disposable liner 114 are as follows. The width of the basin across the top of the liner 114 inclusive of the peripheral flange is approximately 1.6 inches whereas the longitudinal length is approximately 5.5 inches. The width of the peripheral flange is preferably approximately 3/16 of an inch and the depth of the basin is approximately 1.45 inches. The longitudinal length of the bottom of the liner 114 along the trough is, similar to the larger 100 ml version, approximately 4.25 to 4.5 inches in order to accommodate both 8-channel and 12-channel pipettes.

Figure 26:
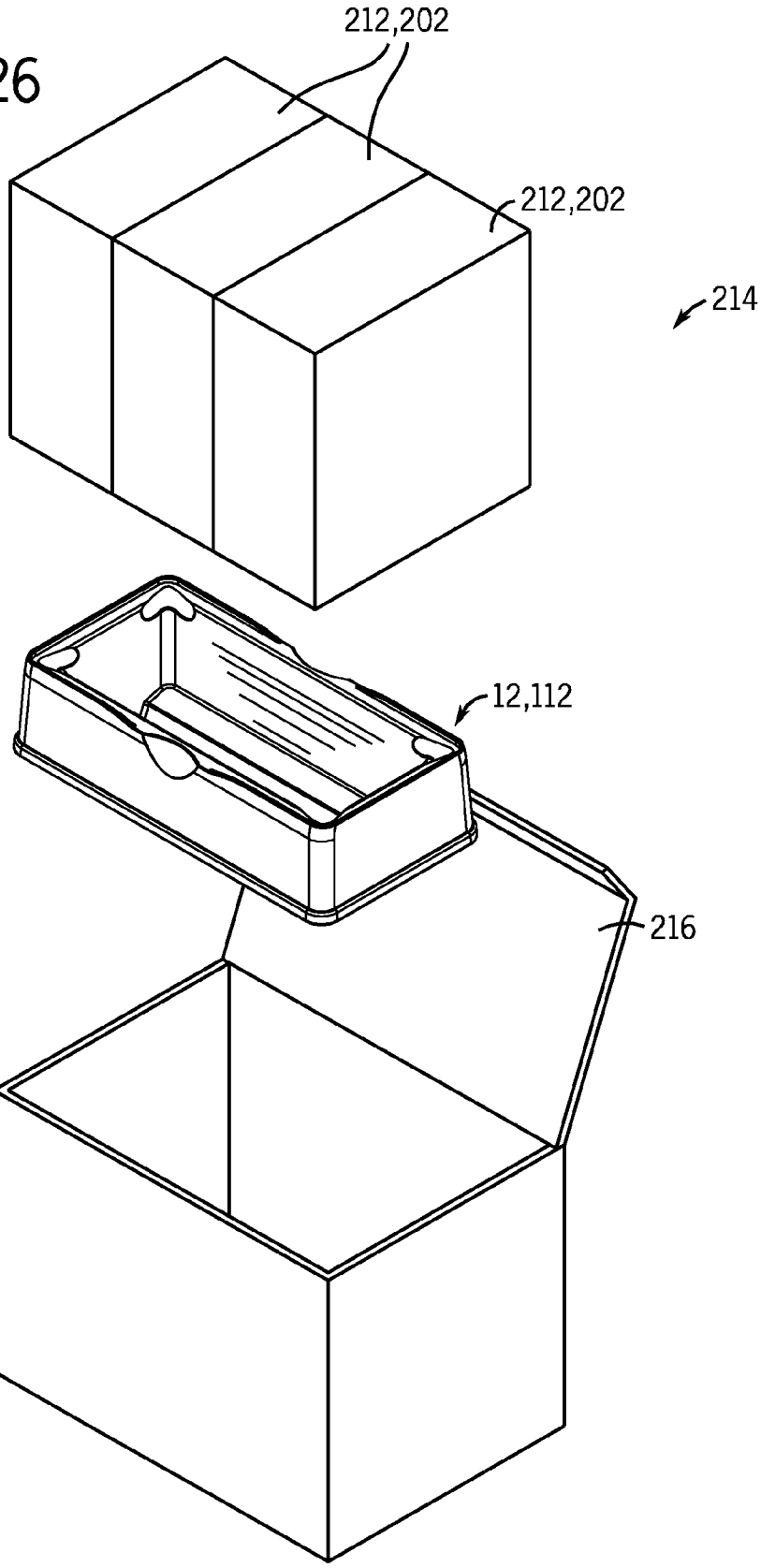
FIG. 26 illustrates a preferred packaging method for nested disposable liners and a reusable reservoir base.
Figure 27:
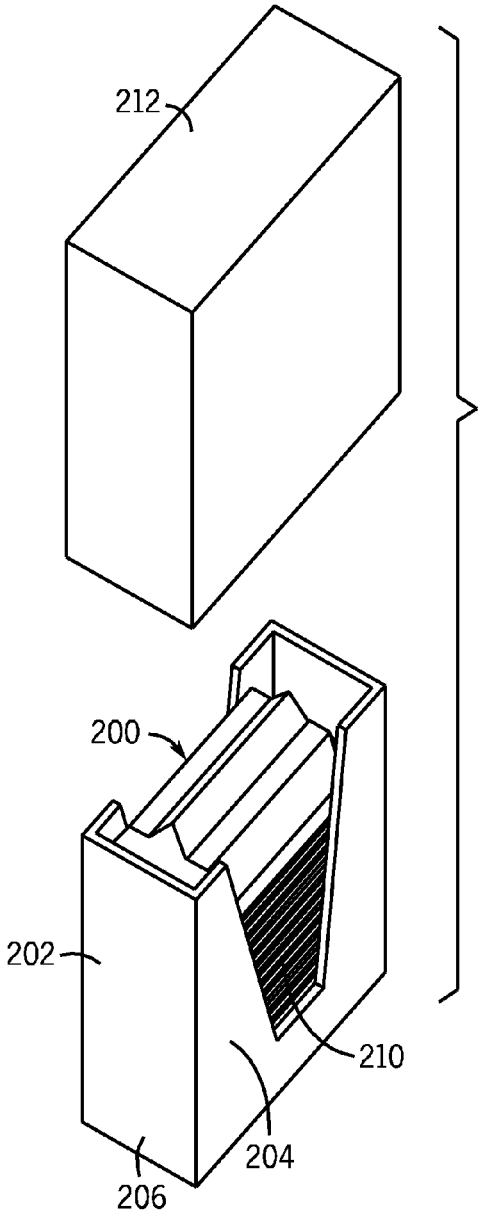
Figure 28:
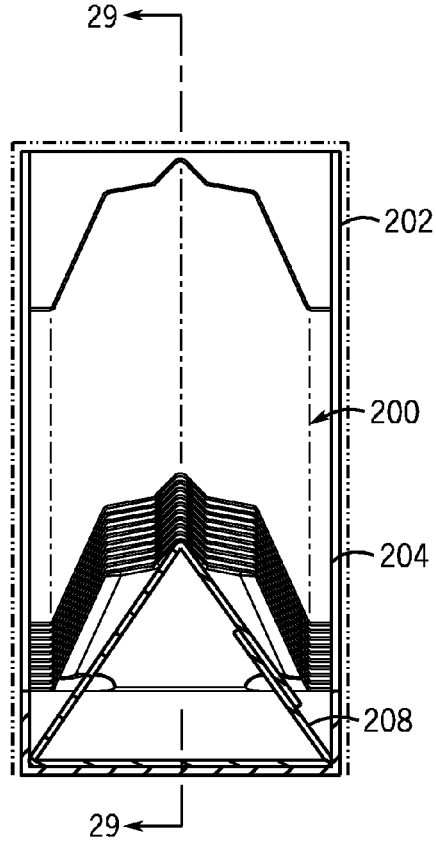

FIGS. 26-29 relate to the preferred packaging system for the reservoir kits 10 and 110. FIGS. 27 through 29 show an inverted stack 200 of nested disposable liners 14 placed within a storage sleeve 202. The sleeve 202 is preferably made of cardboard. Its construction includes sidewalls 204 and endwalls 206. The sidewalls each include a V-cut opening 210 which allows the user to access the stack 200 of disposable liners 14 and conveniently remove one or more liners from the sleeve 202. An inserted standoff 208 formed of cardboard or foam in the shape of a tent is placed within the storage sleeve 202 to support the inverted stack 200 of nested disposable liners 14. The inserted standoff 208 supports the nested stack primarily at the apex of the basin of the lowermost liner 14 in the stack 200. It is important that the V-cut not come closer than ½ inch to the bottom of the sleeve 202 in order to maintain the structural integrity of the cardboard sleeve. Note that the inserted standoff 208 suspends the stack 200 of liners 14 above the bottom of the sleeve 202. By placing the stack 200 of liners 14 in the sleeve 202 so that the liners 14 are inverted allows the laboratory worker to lift one liner from the stack 200 without contaminating the interior functional surface of subsequent liners. It also prevents dust from settling on the interior functional surface of the liners 14. The sleeve 202 with an inverted stack of nested disposable liners 14 thus provides a convenient source of liners to the laboratory worker on the bench top with a relatively small footprint. As shown in FIG. 27, a cover 212 is also preferably provided for shipping or storage of the nested stack 200 or partially used nested stack.

FIG. 26 illustrates a master pack 214 for shipping a reusable base 12, 112 as well as several stacks 200 of nested disposable liners contained in covered sleeves 202, 212 as described in connection with FIGS. 27 and 28. Preferably, a reusable base 12, 112 is secured within the same box 216 as the sleeves of disposable liners 212, 202 for purposes of shipping the product to the customer. As should be apparent from the above description of the invention, many of the functional features reside in the combination of the reusable base with the disposable liner. For example, the disposable liners 14, 114, are not self-supporting. The master packing system shown in FIG. 26 ensures that the customer will have possession of the appropriate reusable base 12, 112 when it receives the associated disposable liners.

FIG. 30 shows a dispenser 218 mounted to a wall 220. The dispenser 218 has a frame 222 with a platform 224. The platform 224 contains an opening 226. The sleeve 202 described in FIGS. 27 through 29 is preferably placed in the dispenser 218 such that the upper opening of the sleeve 202 faces downward with the basins of the liners 14, 114 also facing downward. Note that the sleeve 202 shown in FIG. 30 contains an alternative standoff 208*a*. In FIG. 30, standoff 208*a* is a false bottom standoff on which the inverted stack 200 of liners 14 would normally sit during shipping. The false bottom standoff 208*a*, shown in FIG. 30, may or may not be attached to the sleeve 202, as shown in FIG. 30. The inserted standoff 208 shown in FIGS. 28 and 29 would typically be loose.

The peripheral rim 48, 148 of the lowermost liner 14, 114 in the stack 200, rests on the platform 202 such that the basins of the lowermost liners 114, 14 extend through the opening 226 in the platform. The size of the opening 226 is larger for a dispenser designed for use with the 100 ml liners 14, as for the 25 ml liners 114. A dust cover 228 may be set over the sleeve 202. When a user desires to dispense one of the liners 14, 114, the user grasps the lowermost liner in the stack 200, as illustrated by arrows 230. As the user pushes inward, the liners sitting on top the lowermost liner are pushed upward, and the width of the lowermost liner narrows to allow the lowermost liner to come free, as depicted by liner 14, 114 and arrow 232. Once the lowermost liner 14, 114 is removed through the dispenser opening 116, the remaining portion of the stack 200 in the dispenser settles to rest on the platform 224. Alternatively, as mentioned, an escapement mechanism can be provided to release one liner at a time.

We claim:

1. A laboratory sample reservoir system for use with a handheld pipettor comprising:

a reusable reservoir base providing a stable support on a flat surface, the base having an elongated basin including a pair of endwalls, a longitudinal trough extending along a bottom surface of the basin, and a pair of longitudinal sidewalls extending between the endwalls, each longitudinal sidewall slanting outward as the sidewall extends upward to form a portion of the basin, wherein at least one of the sidewalls has distinct liquid volume graduation marks on an inside surface of the sidewall forming a portion of the basin; and a disposable liner made of formed transparent plastic material, the liner having a basin with a shape that closely follows a contour of the basin of the reusable base thereby rendering the formed disposable liner unable to stand vertically on a flat surface without further support, wherein the liquid volume graduation marks on the sidewall of the basin are calibrated to measure a volume of liquid sample contained in the disposable liner and are observable through the formed transparent disposable liner when the disposable liner is set in place within the reusable base;

wherein the reusable base comprises a rim around an upper end of the basin and the disposable liner further comprises a peripheral flange that extends outward from a top of the liner basin, wherein the peripheral flange rests on the rim of the reusable base when the disposable liner is set in place within the reusable base such that the disposable liner hangs within the reusable base with slight clearance between the liner basin and the basin of the base, and further wherein the disposable liner contains at least one pouring spout formed at an intersection of the peripheral flange and at least one endwall and one sidewall of the disposable liner.

2. The sample reservoir system as recited in claim 1 wherein the disposable liner is made of a clear transparent plastic material with a glossy finish and at least the sidewalls of the reusable reservoir base are opaque and have a surface with a satin finish.

3. The sample reservoir system as recited in claim 1 wherein the trough in the reusable basin contains at least one drainage hole.

4. The sample reservoir system as recited in claim 1 wherein the disposable liner is hung in the reusable basin such that sample liquid contained in the basin of the disposable liner reflects light in order to block the view of the graduation marks on the sidewall of the reusable basin below a top surface of the sample liquid in the basin of the disposable liner from the view of the user for a wide array of user viewing angles.

5. The sample reservoir system as recited in claim 1 wherein the reusable reservoir base further includes a pair of longitudinal steps each extending longitudinally along a respective longitudinal side of the trough and from which one of the respective longitudinal sidewalls extends upwardly.

6. The sample reservoir system as recited in claim 1 wherein the sidewall surface on the reusable base having the liquid volume graduation marks also includes volume amount identification characters which are located slightly above the level of the graduation mark to which it is associated.

7. The sample reservoir system as recited in claim 1 wherein the reusable base further comprises a rim extending around an upper end of the basin and a raised lip extending substantially around the periphery of the rim; and the disposable liner further comprises a peripheral flange that extends outward from a top of the liner basin, wherein the peripheral flange rests on the rim of the reusable base with the raised lip on the base substantially surrounding the peripheral flange on the liner when the disposable liner is set in place within the reusable base.

8. The sample reservoir system as recited in claim 7 wherein the raised lip extending substantially around the periphery of the rim on the reusable base contains a pair of opposed finger access openings.

9. The sample reservoir system as recited in claim 1 wherein at least the sidewalls of the reusable reservoir base are opaque and have a satin finish, and the disposable liner is made of a clear transparent material with a glossy finish.

10. A sample reservoir system for use with handheld pipettor comprising:

a reusable reservoir base having an elongated basin, wherein a contour of the basin includes a pair of endwalls, a longitudinal trough extending along a bottom surface of the basin, and a pair of longitudinal sidewalls extending between the endwalls, each of said longitudinal sidewalls slanting outward as the sidewall extends upward to form a portion of the basin; and a nested stack of formed disposable liners each having a basin with a shape that closely follows the contour of the basin of the reusable base, the disposable liners being made of formed plastic material, and each liner comprising a pair of endwalls and a pair of longitudinal sidewalls which have a draft angle of at least approximately 40° as well as further means for facilitating the release of the disposable liner from the nested stack, thereby allowing relatively dense nesting of the stacked disposable liners in a manner that allows the nested liners to be released easily from one another for use.

11. A sample reservoir system as recited in claim 10 wherein each disposable liner further comprises a peripheral flange extending around an upper end of the liner basin with corner portions being located in the vicinity of the intersection of the sidewalls and the endwalls, and said means for facilitating the release of the disposable liner from the nested stack comprises raised beads formed on an underside of the peripheral flange at each corner of the peripheral flange.

12. A sample reservoir system as recited in claim 10 wherein said means for facilitating the release of the disposable liner from the nested stack comprises a chemical release agent added to the plastic material from which the disposable liners are made are coated at least on a top or side or underside of the disposable liner.

13. The system as recited in claim 10 wherein the volume density of fully nested disposable liners is no less than 60 percent by volume of plastic per total volume of the nested stack.

* * * * *